US012220044B2

(12) United States Patent
Rodriguez

(10) Patent No.: US 12,220,044 B2
(45) Date of Patent: Feb. 11, 2025

(54) BACKPACK FOR PREVENTING INFECTIONS FROM SURFACE AND SKIN CONTACT

(71) Applicant: Eric Alejandro Rodriguez, Fremont, CA (US)

(72) Inventor: Eric Alejandro Rodriguez, Fremont, CA (US)

(73) Assignee: Eric Alejandro Rodriguez, Fremont, CA (US)

( * ) Notice: Subject to any disclaimer, the term of this patent is extended or adjusted under 35 U.S.C. 154(b) by 267 days.

(21) Appl. No.: 17/819,960

(22) Filed: Aug. 16, 2022

(65) Prior Publication Data

US 2022/0400837 A1 Dec. 22, 2022

Related U.S. Application Data

(63) Continuation-in-part of application No. 16/953,410, filed on Nov. 20, 2020, now abandoned.

(51) Int. Cl.

| | |
|---|---|
| ***A45F 3/04*** | (2006.01) |
| *A45F 3/00* | (2006.01) |
| *A45F 4/02* | (2006.01) |

(52) U.S. Cl.

CPC ..... *A45F 3/04* (2013.01); *A45F 2003/001* (2013.01); *A45F 2003/003* (2013.01); *A45F 2004/026* (2013.01)

(58) Field of Classification Search

CPC .. A45F 4/02; A45F 2004/026; A41D 13/0537
USPC ..... 224/155; 297/4
See application file for complete search history.

(56) References Cited

U.S. PATENT DOCUMENTS

| | | | | |
|---|---|---|---|---|
| 4,689,829 | A * | 9/1987 | Kaplan | A41D 27/12 2/467 |
| 5,620,227 | A * | 4/1997 | Brune | A47C 4/52 297/DIG. 6 |
| 5,819,999 | A * | 10/1998 | Tennant | A47C 4/52 224/155 |
| 5,909,802 | A | 6/1999 | Puco et al. | |
| 5,988,465 | A | 11/1999 | Vitale et al. | |
| 6,040,251 | A * | 3/2000 | Caldwell | D06M 15/256 428/305.5 |
| 6,655,736 | B1 | 12/2003 | Arenas | |

(Continued)

FOREIGN PATENT DOCUMENTS

KR 20110084349 A * 7/2011

*Primary Examiner* — Scott T McNurlen
(74) *Attorney, Agent, or Firm* — Jason C. Cameron

(57) ABSTRACT

A backpack for preventing infections from surface and skin contact is disclosed. The backpack includes a sleeve, a pair of shoulder straps, and a protector including a top handle section connected with a pair of pulling straps, a middle padded section coupled to the top handle section, and a bottom section. Furthermore, the backpack includes a magnetic slide track fastener including a magnetic ring fixed at a bottom end of each of the pair of shoulder straps, and a magnetic pin fixed at a bottom end of each of the pair of pulling straps. When the magnetic pin is released from the magnetic ring via the downward sliding motion, the middle padded section protracts out of the sleeve. The magnetic pin is removably attached with the magnetic ring via the upward sliding motion of the magnetic pin to hold the middle padded section in a retracted position.

20 Claims, 17 Drawing Sheets

(56) References Cited

U.S. PATENT DOCUMENTS

| | | | | |
|---|---|---|---|---|
| 9,221,372 | B1 * | 12/2015 | Lacey | B60N 2/6036 |
| 10,463,093 | B2 | 11/2019 | Matthews | |
| 11,229,278 | B2 * | 1/2022 | Hassett | A45F 3/04 |
| 2007/0012735 | A1 | 1/2007 | Lee et al. | |
| 2007/0210125 | A1 * | 9/2007 | Grabijas | A45F 3/04<br>224/155 |
| 2015/0320219 | A1 * | 11/2015 | Berns | A45F 4/02<br>297/4 |
| 2016/0174691 | A1 * | 6/2016 | Chapuis | A45F 3/04<br>224/605 |

* cited by examiner

BACKPACK FOR PREVENTING INFECTIONS FROM SURFACE AND SKIN CONTACT

CROSS-REFERENCE TO RELATED APPLICATIONS

This continuation-in-part (CIP) Application claims priority from a patent application filed in the United States having patent application Ser. No. 16/953,410 filed on Nov. 20, 2020, and titled "A BACKPACK FOR PREVENTING INFECTION FROM SURFACE AND SKIN CONTACT".

FIELD OF INVENTION

Embodiments of a present disclosure relates to a device to protect a user from contagious diseases which spread by surface and skin contact, and more particularly relates to a backpack for preventing infections from surface and skin contact.

BACKGROUND

There are several contagious diseases which spread by surface and skin contact, such as COVID-19, Monkeypox, and the like. The world is facing a pandemic of COVID-19 which has taken toll of thousands of lives across the world. It is highly contagious and transmits through human to human by way of surface contamination.

The COVID-19 transmits in the human population by aerosol and fomites. The aerosol transmission from infected individuals to susceptible individuals is the cause of rapid spread of the virus in the population. The COVID-19 may also survive on surfaces such as tables, clothes, mobiles, metal, paper, and objects used by humans regularly in day-to-day life. Further, the Monkeypox can also spread through close, personal, and often skin-to-skin contact. For example, the Monkeypox may spread through direct contact with monkeypox rash, scabs, or body fluids from a person with monkeypox. The Monkey pox may also spread through touching objects, fabrics, such as clothing, bedding, or towels, surfaces that have been used by someone with monkeypox, and contact with respiratory secretions.

Currently, numerous sanitization techniques, sanitizers, masks, gloves, face shields, and Personal Protective Equipment (PPE) kits are available to reduce and avoid the spread of the contagious diseases. The world health organization and national health authorities have started a global campaign called "Stop the Spread" which aims to raise awareness, about the risks of the spread and misinformation around COVID-19, from the trusted sources. However, the use of sanitization techniques and sanitizers have limitations such as, continuous or overuse of alcohol-based sanitizers may cause skin irritation, cracking, and bleeding from hands of a user. Also, according to germ experts, hand sanitizers last only for a duration of two minutes once applied, thereby increasing risk of contamination, and spread of viruses and bacteria.

Further, there are disinfectant sprays available in market which may disinfect any surface to a certain extent. However, improper spraying may leave certain areas on the surface untreated, hence risk of infection is always looming. Furthermore, it is not user friendly since fumigation or spraying of disinfectants causes breathing discomfort in some people. Also, if a person is out and working whole day, then there is high chance that the person may run out of the disinfectant. This may leave the person vulnerable in certain situations Hence, there is a need for a backpack for preventing infections from surface and skin contact, in order to address the aforementioned issues. The backpack provides prolonged, effective, and user-friendly control measure to avoid spread of the contagious microbes that spread by surface or skin contact.

SUMMARY

In accordance with one embodiment of the disclosure, a backpack for preventing infections from surface and skin contact is disclosed. The backpack includes a sleeve, a pair of shoulder straps, a protector, and a magnetic slide track fastener. Further, the sleeve is configured to cover a length of a backpack. The length corresponds to a distance between a top end and a bottom end of the backpack. The sleeve is fabricated by joining a pair of sheets. Furthermore, edges of the pair of sheets are fused lengthwise to each other on a set of sides to form an opening at bottom side of the backpack. The pair of shoulder straps are coupled to a top portion and a bottom portion of the sleeve. The pair of shoulder straps are configured to position the sleeve on a shoulder of a user. Further, the protector is housed inside the sleeve. The protector includes a top handle section connected with a pair of pulling straps. The pair of pulling straps one of: passes through and alongside the pair of shoulder straps. The pair of pulling straps includes one or more predefined sections of one or more fastening means to affix the top handle section to the backpack at a convenient height with respect to the user. Furthermore, the protector includes a middle padded section coupled to the top handle section and configured to act as a protective layer between a cloth worn by a user and a seating surface. The protector also includes a bottom section coupled to the middle padded section and protruding out of the opening of the sleeve. Further, the magnetic slide track fastener includes a magnetic ring fixed at a bottom end of each of the pair of shoulder straps. The magnetic ring includes a curved space to facilitate upward sliding motion and a lower sliding motion of a magnetic pin. The magnetic slide track fastener also includes the magnetic pin fixed at a bottom end of each of the pair of pulling straps. When the magnetic pin is released from the magnetic ring via the downward sliding motion through the curved space, the middle padded section protracts out of the sleeve via the opening due to movement of the pair of pulling straps in downward direction. The middle padded section is positioned over a seating surface to act as a protective layer between cloth worn by the user and the seating surface in a protracted position. When the pair of pulling straps are pulled by the user, the middle padded section retracts inside the sleeve via the opening. The magnetic pin is removably attached with the magnetic ring via the upward sliding motion of the magnetic pin through the curved space to hold the middle padded section in a retracted position inside the sleeve.

In accordance with another embodiment of the disclosure, a wearable guard for preventing infections from surface and skin contact is disclosed. The wearable guard includes a sleeve, a pair of shoulder straps, a protector, and a magnetic slide track fastener. The sleeve is configured to be worn as one of: a backpack and a sack. Further, the sleeve is fabricated by joining a pair of sheets. Edges of the pair of sheets are fused lengthwise to each other on a set of sides to form an opening at bottom side of the sleeve. The pair of shoulder straps are coupled to a top portion and a bottom portion of the sleeve. The pair of shoulder straps are configured to position the sleeve on a shoulder of a user. Further, the protector is housed inside the sleeve. The protector includes a top handle section connected with a pair of pulling straps. The pair of pulling straps one of: passes through and alongside the pair of shoulder straps. The pair of pulling straps includes one or more predefined sections of one or more fastening means to affix the top handle section to the sleeve at a convenient height with respect to the user. Furthermore, the protector includes a middle padded section coupled to the top handle section and configured to act as a protective layer between a cloth worn by a user and a seating surface. The protector also includes a bottom section coupled to the middle padded section and protruding out of the opening of the sleeve. Further, the magnetic slide track fastener includes a magnetic ring fixed at a bottom end of each of the pair of shoulder straps. The magnetic ring includes a curved space to facilitate upward sliding motion and a lower sliding motion of a magnetic pin. The magnetic slide track fastener also includes the magnetic pin fixed at a bottom end of each of the pair of pulling straps. When the magnetic pin is released from the magnetic ring via the downward sliding motion through the curved space, the middle padded section protracts out of the sleeve via the opening due to movement of the pair of pulling straps in downward direction. The middle padded section is positioned over a seating surface to act as a protective layer between cloth worn by the user and the seating surface in a protracted position. When the pair of pulling straps are pulled by the user, the middle padded section retracts inside the sleeve via the opening. The magnetic pin is removably attached with the magnetic ring via the upward sliding motion of the magnetic pin through the curved space to hold the middle padded section in a retracted position inside the sleeve.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1A:
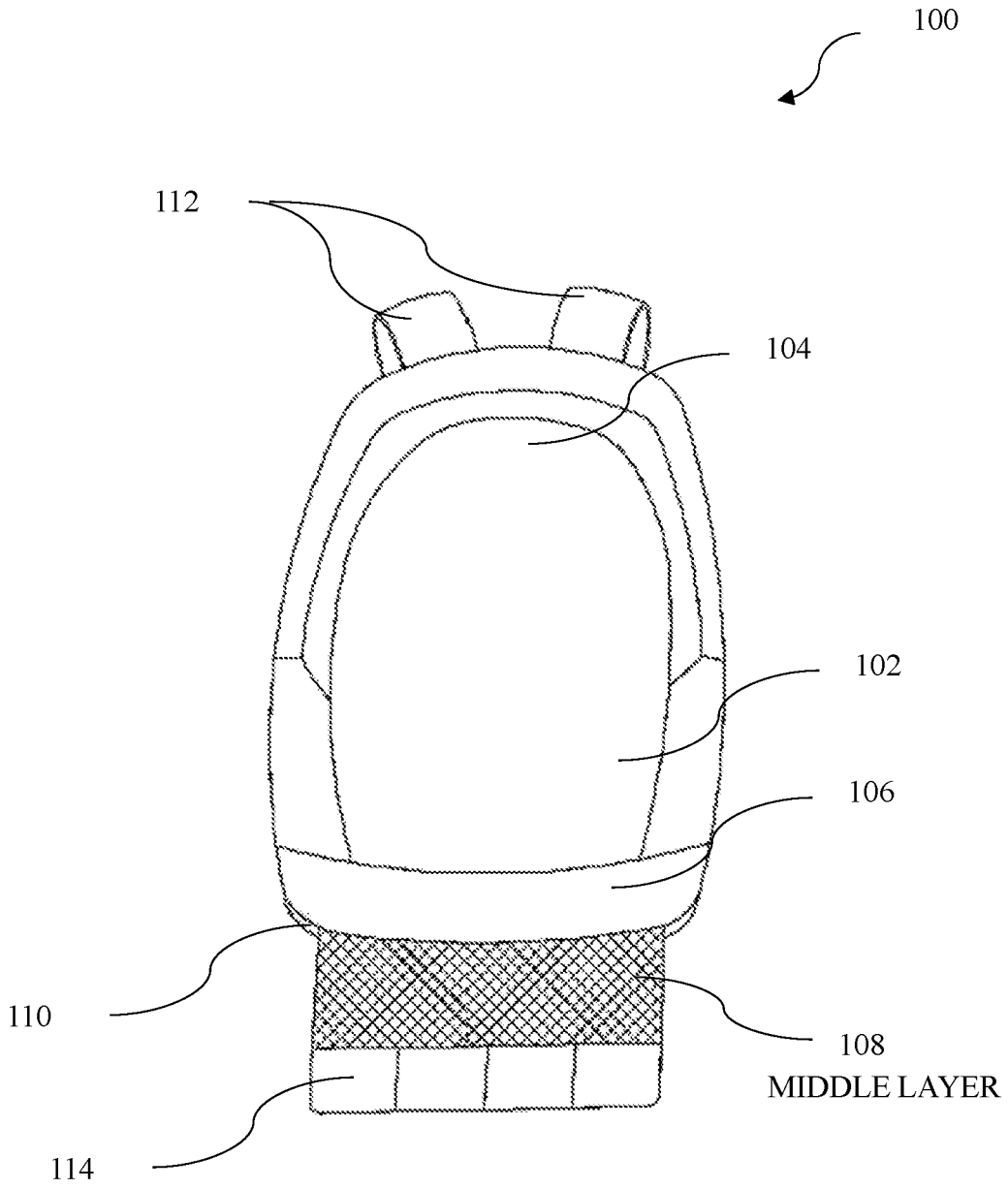
FIG. 1A is a front view of an exemplary backpack for preventing infections from surface and skin contact, in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION OF THE DISCLOSURE

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated online platform, and such further applications of the principles of the disclosure as would normally occur to those skilled in the art are to be construed as being within the scope of the present disclosure.

The terms “comprises”, “comprising”, or any other variations thereof, are intended to cover a non-exclusive inclusion, such that a process or method that comprises a list of steps does not include only those steps but may include other steps not expressly listed or inherent to such a process or method. Similarly, one or more devices or subsystems or elements or structures or components preceded by "comprises . . . a" does not, without more constraints, preclude the existence of other devices, subsystems, elements, structures, components, additional devices, additional subsystems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

Referring now to the drawings, and more particularly to FIG. 1A through FIG. 11, where similar reference characters denote corresponding features consistently throughout the figures, there are shown preferred embodiments and these embodiments are described in the context of the following exemplary system and/or method.

In the following specification and the claims, reference will be made to a number of terms, which shall be defined to have the following meanings. The singular forms "a", "an", and "the" include plural references unless the context clearly dictates otherwise.

Figure 1B:
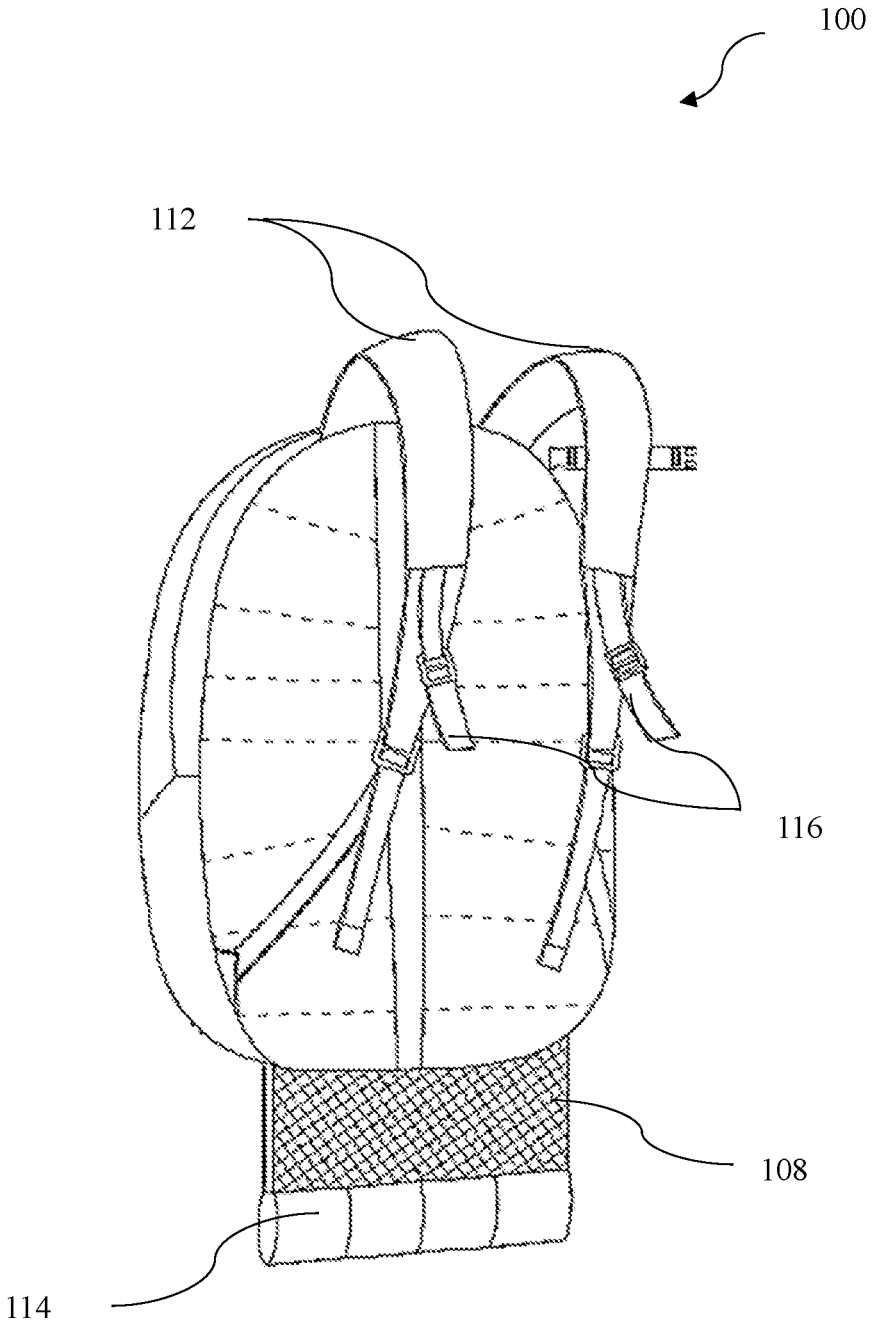
FIG. 1B is a rear view of the exemplary backpack for preventing infections from surface and skin contact, in accordance with an embodiment of the present disclosure.

FIG. 1A is a front view of an exemplary backpack 100 for preventing infections from surface and skin contact, in accordance with an embodiment of the present disclosure. Further, FIG. 1B is a rear view of the exemplary backpack 100 for preventing infections from surface and skin contact, in accordance with an embodiment of the present disclosure. For the sake of brevity, FIG. 1A and FIG. 1B have been explained together.

In an embodiment of the present disclosure, the backpack 100 includes a sleeve 102 configured to cover a length of the backpack 100, as shown in FIG. 1A. The length may be defined as a distance between a top end 104 and a bottom end 106 of the backpack 100. In an embodiment of the present disclosure, the sleeve 102 is fabricated by joining a pair of sheets of a fabric or a flexible polymer. Further, inner walls of the sleeve 102 form a defined space for housing a protector 108 inside the sleeve 102. In an embodiment of the present disclosure, edges of the pair of sheets are fused lengthwise to each other on a set of sides to form an opening 110 at the bottom side of the backpack 100. In an exemplary embodiment of the present disclosure, the set of sides are three sides, such as a top side, a left side and a right side. The edges of the two sheets may be fused lengthwise to each other by using a plurality of means, such as stitching, gluing, sewing, and like. In an alternative embodiment, the sleeve 102 may be created with a single sheet of the fabric or the flexible polymer by folding. In such an embodiment, the single sheet is folded at middle in order to form the housing to receive the protector 108. In yet another embodiment, the sleeve 102 may be formed by creating a space between two fabric layers of the backpack 100 itself for housing the protector 108.

Further, the sleeve 102 is detachably attached to the backpack 100 by using one or more attaching means. In an exemplary embodiment of the present disclosure, the one or more attaching means include one or more knots, zipper, buttons, clasps, hook and loop type fasteners, buckle fasteners, magnets or any combination thereof. In such an embodiment, the sleeve 102 is slid within a defined space between two layers of fabric layers of the backpack 100 via the opening 110 and detachably attached to the top end 104 of backpack 100.

In an embodiment, the sleeve 102 includes similar fabric material and color as of the backpack 100. In another embodiment, the sleeve 102 includes contrast colour to the backpack 100.

Furthermore, the backpack 100 includes a pair of shoulder straps 112 coupled to a top portion and a bottom portion of the sleeve 102, as shown in FIG. 1A. In an embodiment of the present disclosure, the pair of shoulder straps 112 are configured to position the sleeve 102 on a shoulder of a user. Further, the backpack 100 includes the protector 108 housed in the sleeve 102. The protector 108 includes a top handle section, a middle padded section and a bottom section 114. In an embodiment of the present disclosure, the backpack 100 includes a pair of pulling straps 116, as shown in FIG. 1A. Details on the top handle section, the middle padded section, the bottom section 114, and the pair of pulling straps 116 have been elaborated in subsequent paragraphs of the present description with reference to FIG. 2. According to some embodiments, bottom section 114 serves as a stopper to prevent 206 from going into the opening 110 and housing.

Figure 2:
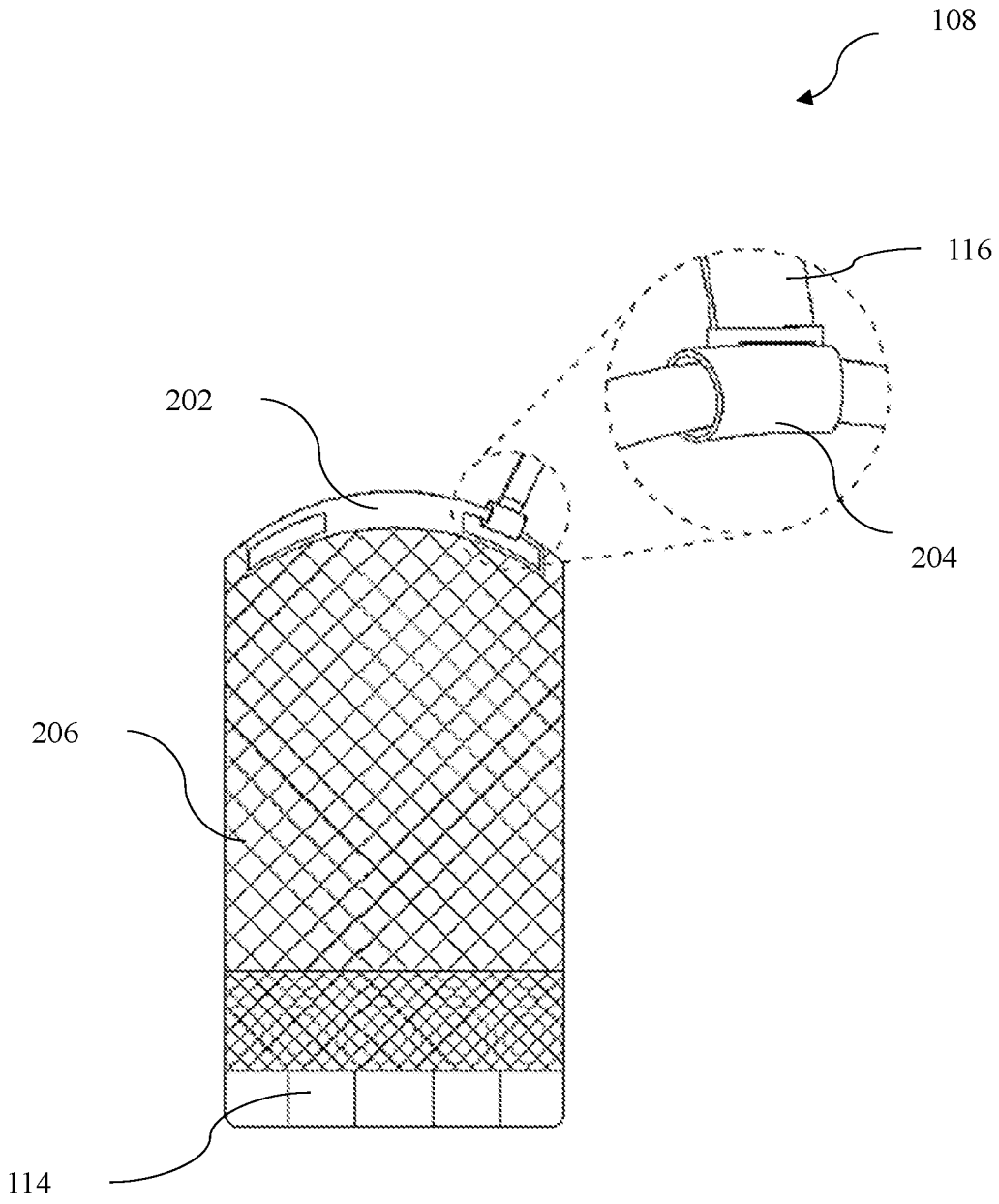
FIG. 2 is a front view of an exemplary protector of the backpack, in accordance with an embodiment of the present disclosure.

FIG. 2 is a front view of the exemplary protector 108 of the backpack 100, in accordance with an embodiment of the present disclosure. The protector 108 includes the top handle section 202 connected with the pair of pulling straps 116. The pair of pulling straps 116 are designed to pass through or alongside the pair of shoulder straps 112 of the backpack 100 and fall before front side shoulder of the user of the backpack 100. Therefore, the pair of pulling straps 116 is accessible to the user for pulling with hands, thereby enabling the user to move the protector 108 from a protracted position to a retracted position inside the sleeve 102 via the opening 110.

Figure 9A:
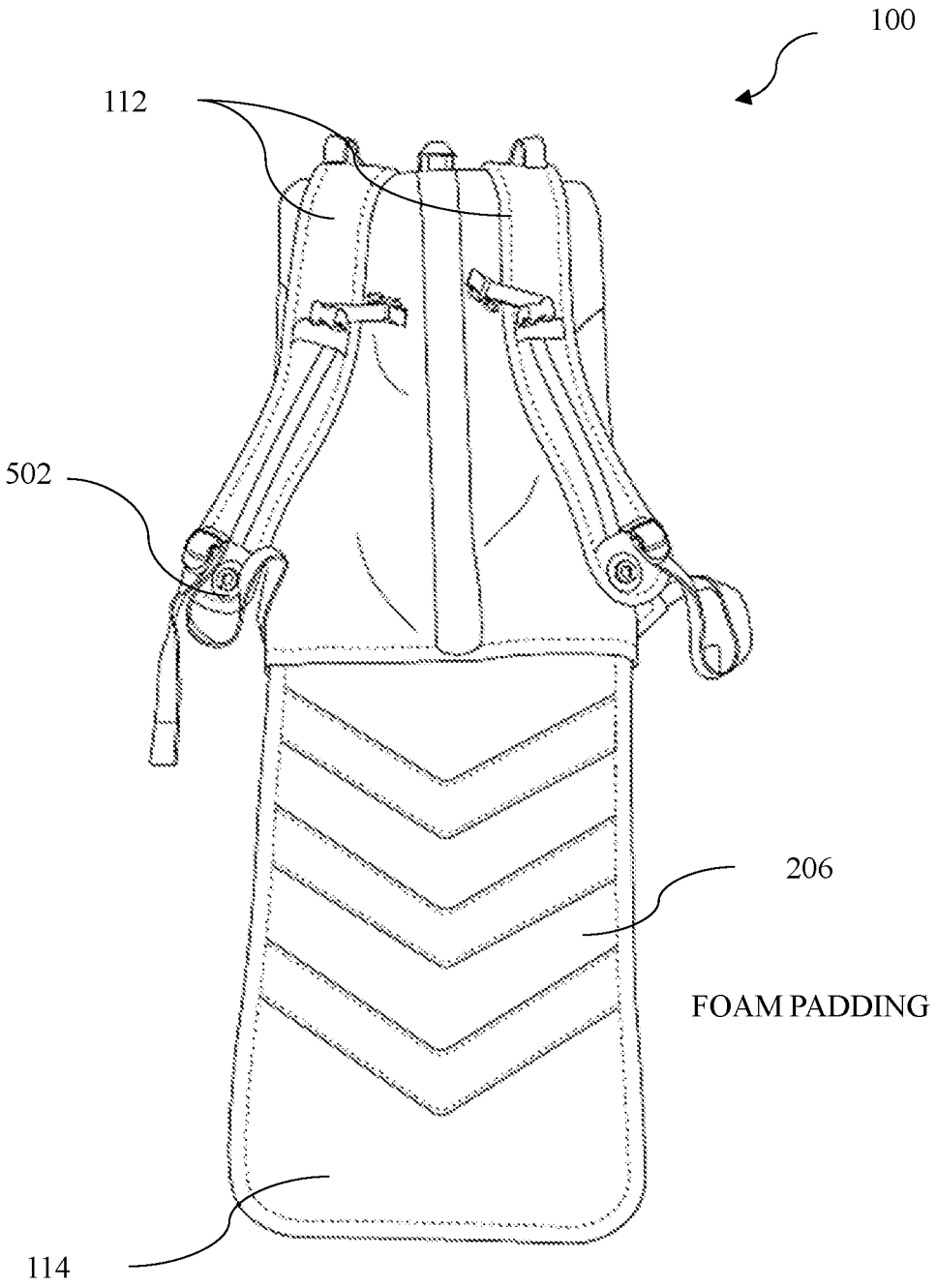
FIG. 9A is a rear view of the exemplary backpack in a protracted position, in accordance with an embodiment of the present disclosure.
Figure 9B:
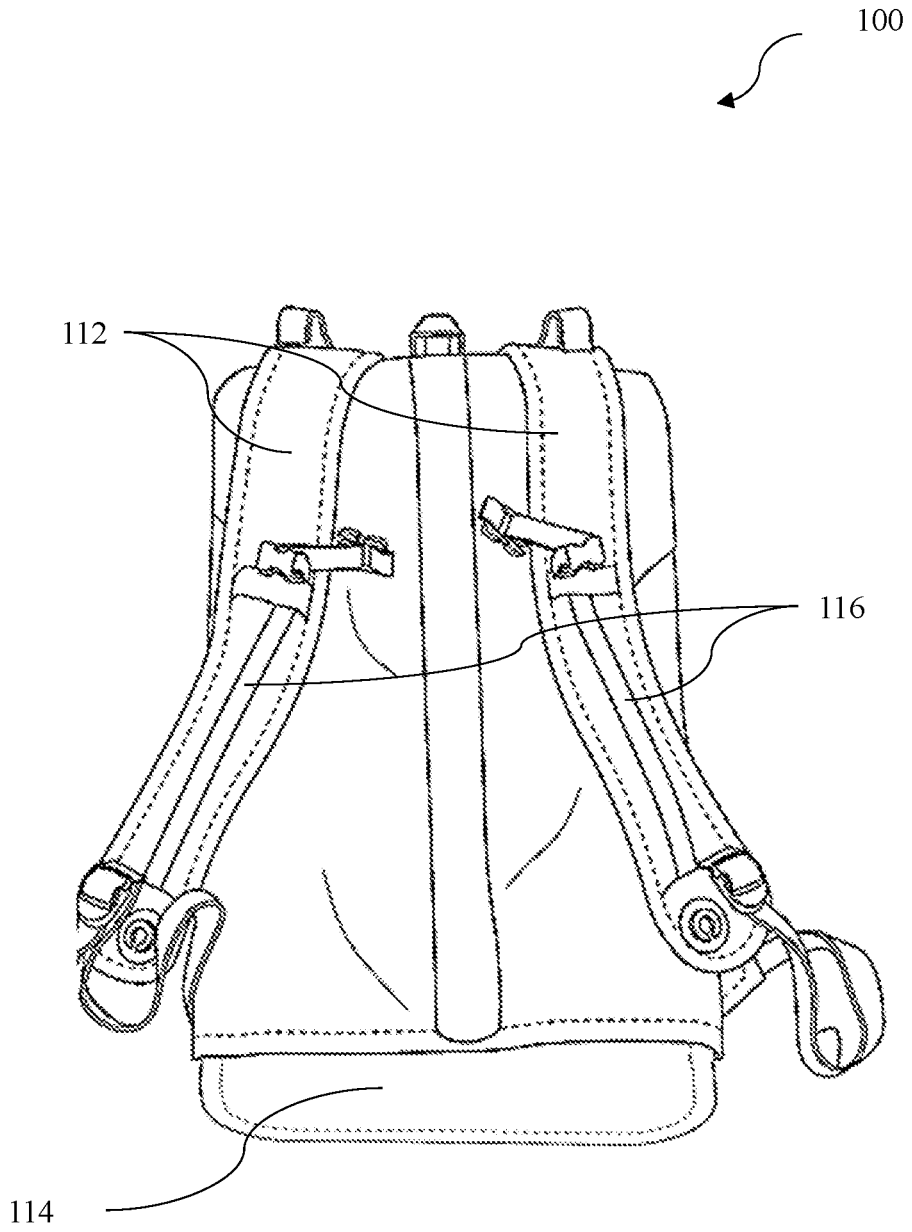
FIG. 9B is a rear view of the exemplary backpack in a retracted position, in accordance with an embodiment of the present disclosure.

In an embodiment of the present disclosure, the top handle section 202 is connected to the pair of pulling straps 116 via a set of rollers 204 configured to enable a rolling motion during movement of the protector 108 from the protracted position to the retracted position. In an embodiment of the present disclosure, in the protracted position, the middle padded section 206 is protracted outside the sleeve 102 via the opening 110. Further, in the retracted position, the middle padded section 206 is retracted inside the sleeve 102. The protracted position is depicted in FIG. 9A, and the retracted position is depicted in FIG. 9B. In an embodiment of the present disclosure, the top handle section 202 in located inside the sleeve 102 and the bottom section 114 is protruding out of the opening 110 of the sleeve 102 in both the retracted position and the protracted position of the middle padded section 206. The pair of pulling straps 116 includes one or more predefined sections of one or more fastening means 118 to affix the top handle section 202 to the backpack 100 at a convenient height with respect to the user. In exemplary embodiment of the present disclosure, the one or more fastening means 118 include knots, a zipper, buttons, clasps, hook and loop type fasteners, buckle fasteners, magnets or any combination thereof. As used herein, the term 'fastening means' refers to a device that closes or secures something. In an exemplary embodiment, the pair of pulling straps 116 includes one or more buckle fasteners to fasten or affix the top handle section 202 to the backpack 100. The one or more buckle fasteners provide firm and effective grip in fastening the pair of pulling straps 116.

Furthermore, the protector 108 includes the middle padded section 206 coupled to the top handle section 202. The middle padded section 206 is configured to act as a protective layer between a cloth worn by the user and a seating surface. For example, the seating surface may be a seat in a public vehicle, such as train and bus, a bench in a park, and the like. In an exemplary embodiment, the middle padded section 206 is made up of self-disinfecting fabric or material. In such embodiment, the middle padded section 206 not only protects the clothing of the user but also enables killing bacteria and viruses, thereby minimizing contamination and infection. The self-disinfecting fabric or material may impregnate with hydroxyapatite-binding silver $TiO_2$ or quaternary ammonium salt. The hydroxyapatite-binding silver $TiO_2$ or quaternary ammonium salt possess significant antimicrobial activity. Hence, impregnated fabric may effectively protect the clothing of the user wearing the backpack 100 with the protector 108.

In an embodiment of the present disclosure, the protector 108 also includes the bottom section 114 coupled to the middle padded section 206 and protruding out of the opening 110 of the sleeve 102. The bottom section 114 is configured to act as a handle enabling the user to pull the pair of pulling straps 116 for moving the middle padded section 206 from the retracted position to the protracted position. The middle padded section 206 is moved from the retracted position to the protracted position for positioning the middle padded section 206 over the seating surface to act as the protective layer between the cloth worn by the user and the seating surface. Therefore, the user may pull down the protector 108 when about to sit or come in contact with any surface, where the middle padded section 206 forms an insulation between the clothes worn by the user and a surface. Further, when the user gets up, the user may pull up the protector 108 using the pair of pulling straps 116 inside the sleeve 102.

Further, the bottom section 114 includes a predefined weight to add a pull weight to keep the protector 108 straight, open and without any fold for having a maximum coverage of the seating surface. In an embodiment of the present disclosure, the bottom section 114 has more thickness as compared to the opening 110 for allowing the bottom section 114 to act as a stopper. The bottom section 114 acts as the stopper for preventing the middle padded section 206 to be pulled in completely inside the sleeve 102 while moving the middle padded section 206 from the protracted position to the retracted position.

Furthermore, the protector 108 is washable for purposes of removing germs, contamination and dirt. The protector 108 is fabricated with, but is not limited to, a water-resistant material that is machine-washable and durable. The protector 108 is fabricated from a set of materials. In an exemplary embodiment of the present disclosure, the set of materials include a self-disinfecting, water-resistant, anti-microbial, copper oxide, silver ion, zinc, vinyl, polyester, natural fibres, artificial fibres, paper based materials, and the like.

Figure 3A:
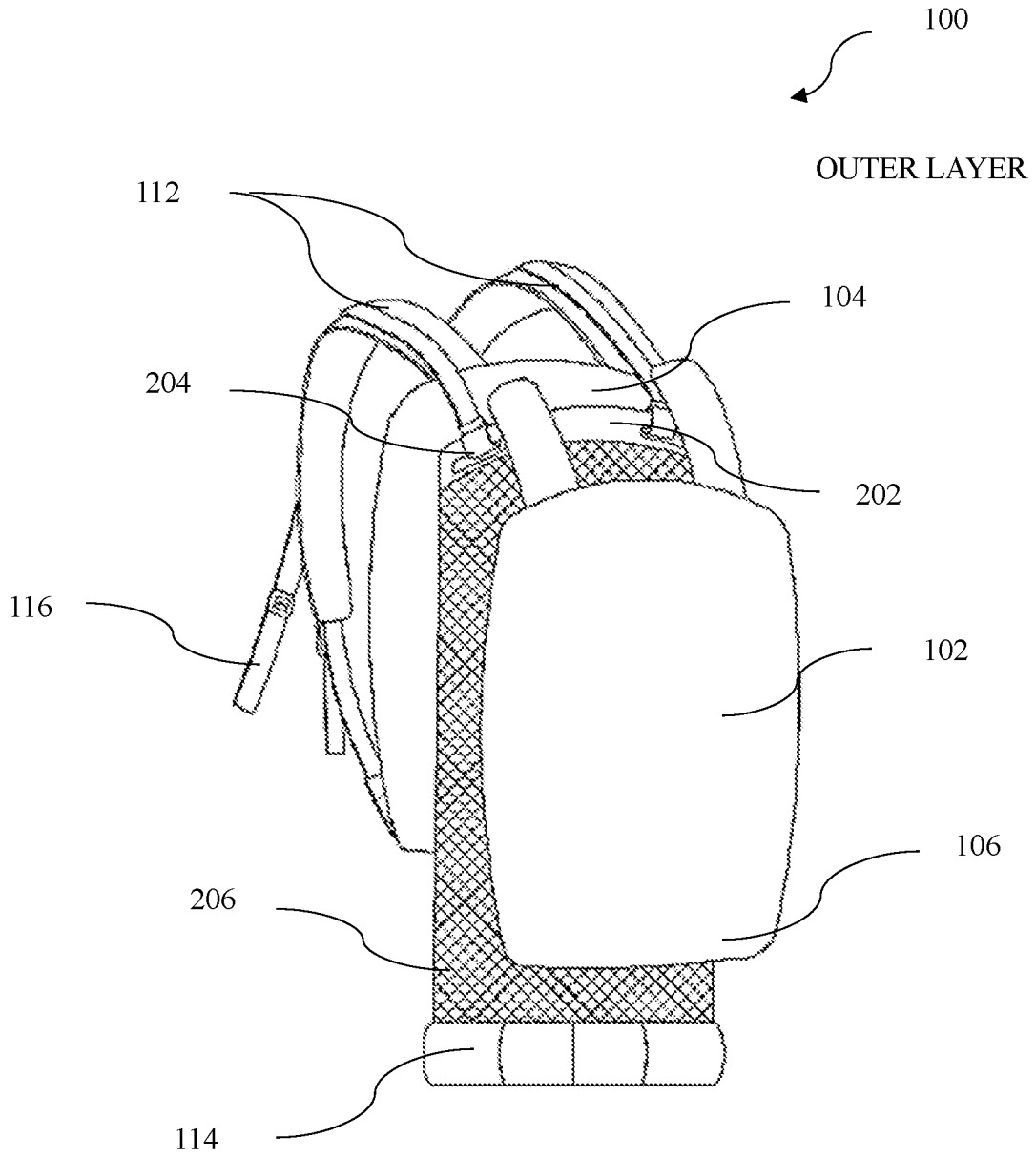
FIG. 3A is an exploded view of the exemplary backpack, in accordance with an embodiment of the present disclosure.
Figure 3B:
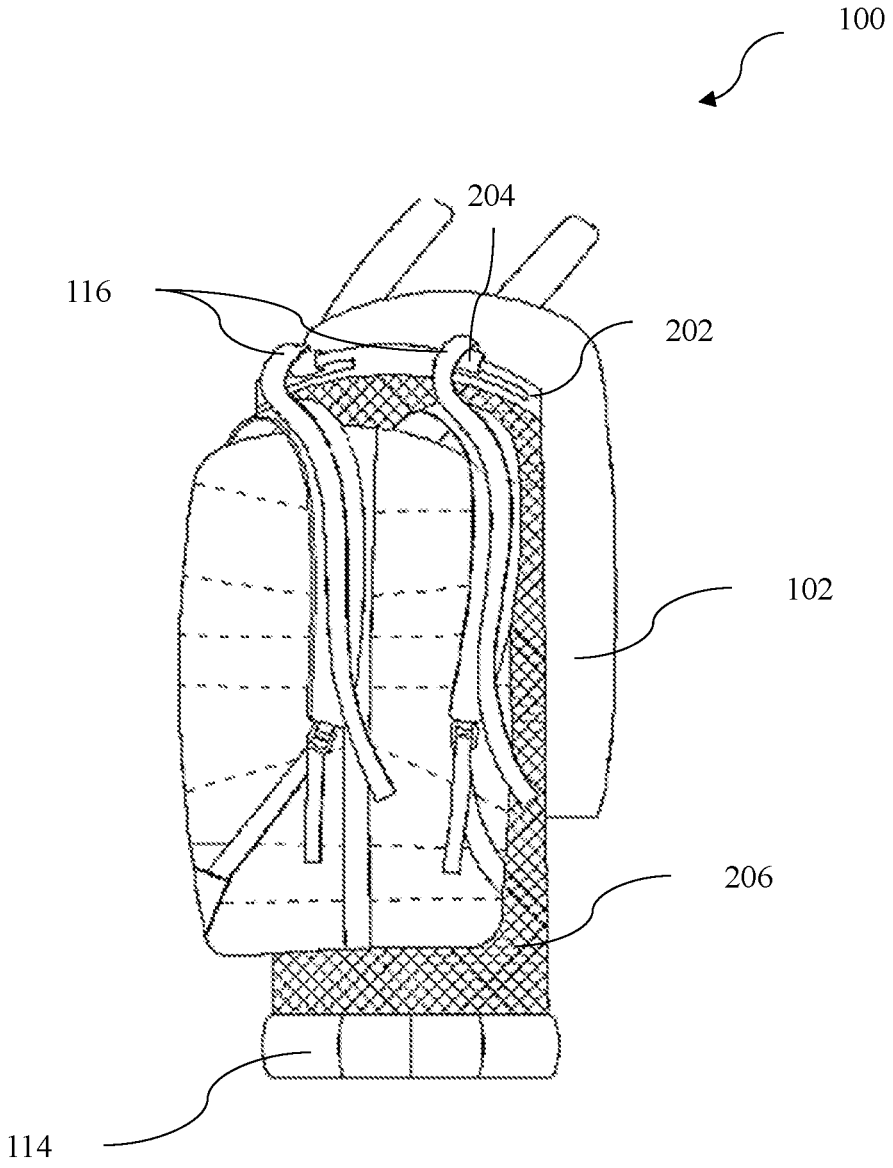
FIG. 3B is an exploded view of the exemplary backpack, in accordance with another embodiment of the present disclosure.

FIG. 3A is an exploded view of the exemplary backpack 100, in accordance with an embodiment of the present disclosure. Further, FIG. 3B is an exploded view of the exemplary backpack 100, in accordance with another embodiment of the present disclosure. For the sake of brevity, FIG. 3A and FIG. 3B have been explained together.

Figure 3C:
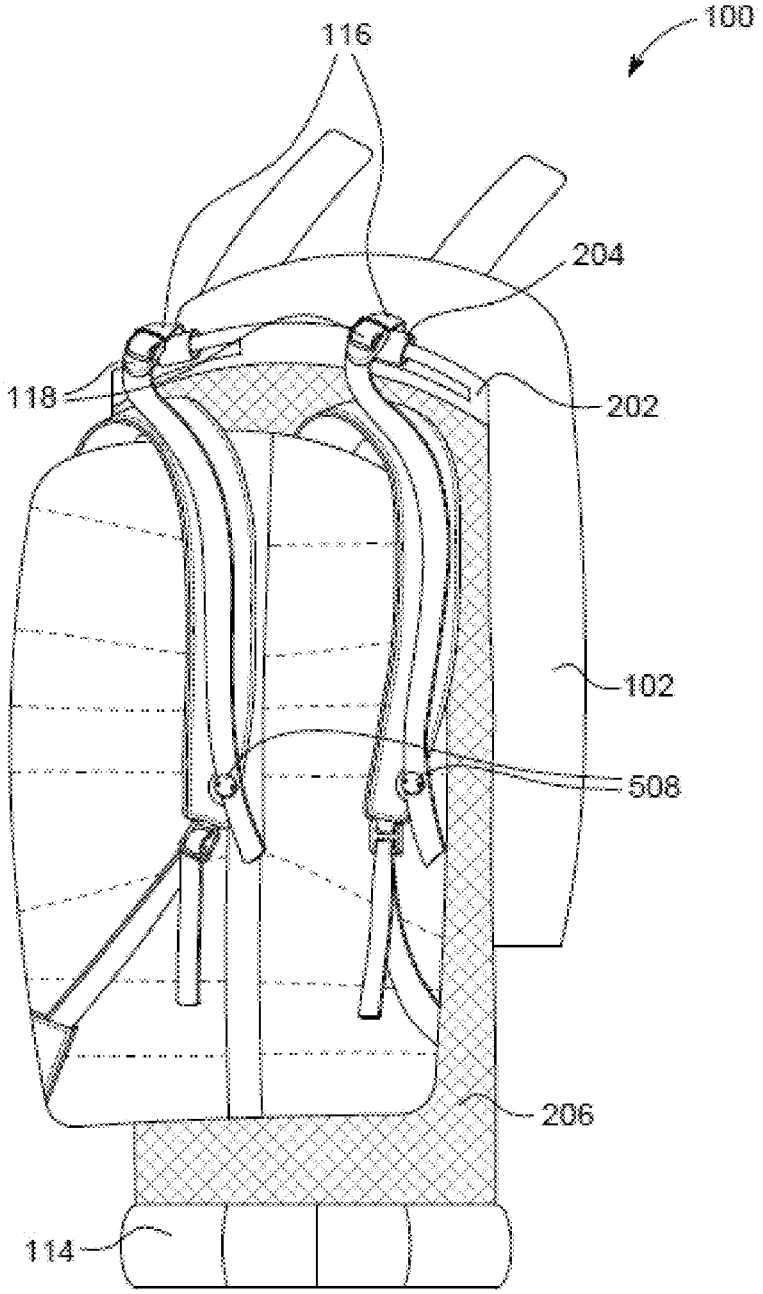
FIG. 3C is an isometric view of the exemplary backpack illustrating the protraction and retraction of the protector in backpack, in accordance with yet another embodiment of the present disclosure.

Further, FIG. 3A and, FIG. 3B, and FIG. 3C depicts a set of layers in the backpack 100 and position of the protector 108 housed inside the sleeve 102 onto the backpack 100 by pulling the pair of pulling straps 116 attached to the top handle section 202 of the protector 108. In an embodiment, the backpack 100 includes the set of layers in following sequence: an outer layer, the sleeve 102, a middle layer, and an inner layer. In an embodiment of the present disclosure, space between the middle layer and the inner layer forms one or more compartments of the backpack 100.

FIG. 3C is an isometric view of the exemplary backpack illustrating the protraction and retraction of the protector 108 in the backpack, in accordance with another embodiment of the present disclosure. FIG. 3C illustrates the set of rollers 204 configured to enable a rolling motion during movement of the protector 108 from the protracted position to the retracted position and vice versa. Further, the one or more fastening means 118 attached to the set of rollers 204 enable affixing the top handle section 202 to the backpack 100 at a convenient height with respect to the user. Additionally, the protraction of the protector 108 includes the following steps. In the first step, the magnetic slide track fastener 508 affixed to the pair of pulling straps 116 is disengaged. In the second step, the pair of pulling straps 116 via the set of rollers 204 enable a downward rolling motion during movement of the protector 108 from the retracted position to the protracted position. In the third step, the one or more fastening means 118 affixes the top handle section 202 to the backpack 100 at a convenient height with respect to the user.

Figure 4:
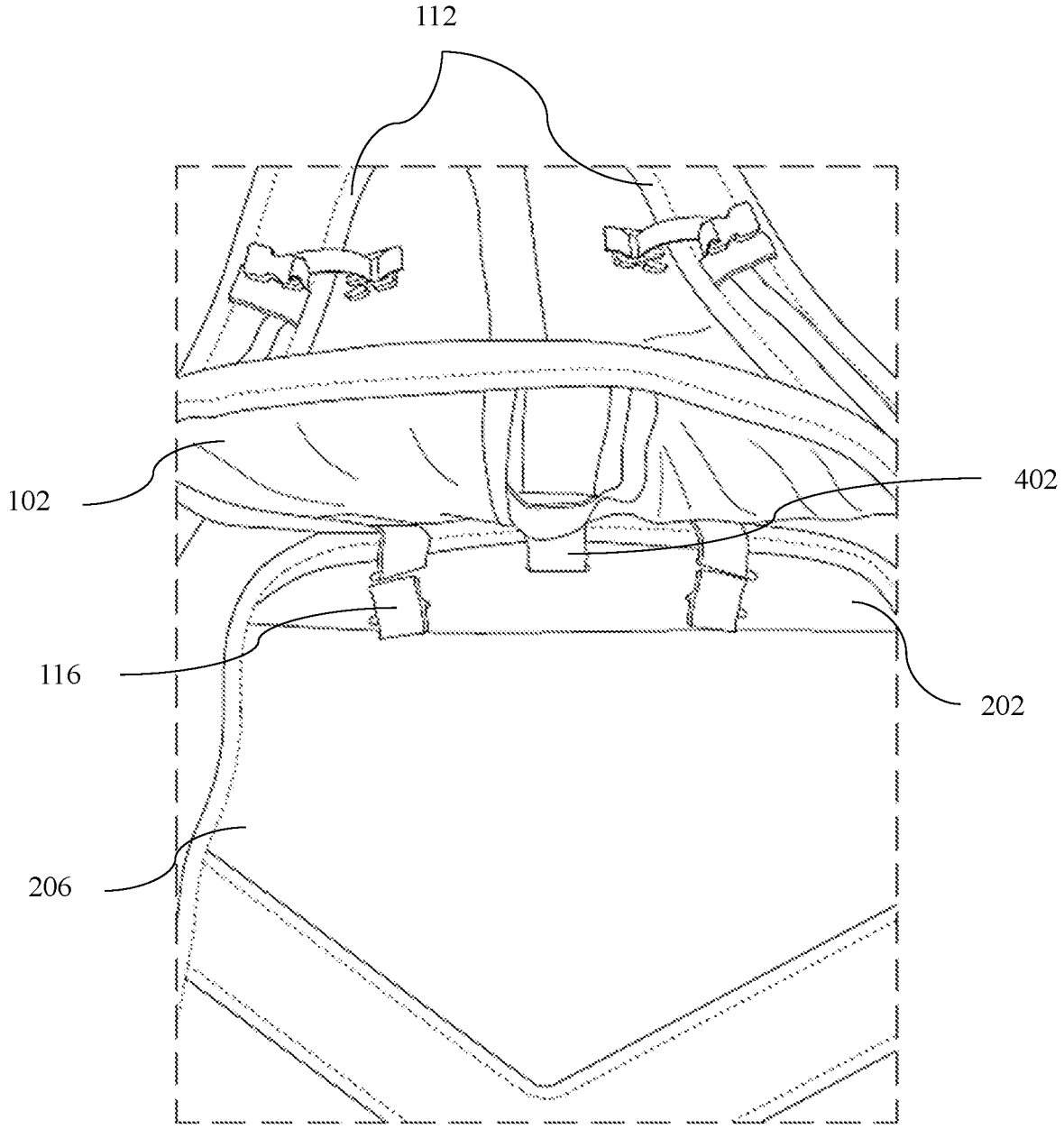
FIG. 4 is a top view of an exemplary top handle section connected with a pair of pulling straps, in accordance with an embodiment of the present disclosure.

FIG. 4 is a top view of the exemplary top handle section 202 connected with the pair of pulling straps 116, in accordance with an embodiment of the present disclosure. In an exemplary embodiment of the present disclosure, the top handle section 202 is made of High Density Polyethylene (HDPE). The top handle section 202 is attached atop of the middle padded section 206 of the backpack 100. Further, the backpack 100 includes a rail strap 402. In an embodiment of the present disclosure, each of the pair of pulling straps 116 and the rail strap 402 includes a first end and a second end. Further, the first end of each of the pair of pulling straps 116 and the rail strap 402 is attached with the top handle section 202. Furthermore, the second end of each of the pair of pulling straps 116 and the rail strap 402 is attached with an inner portion of sleeve 102. The second end of the rail strap 402 is attached with the inner portion of the sleeve 102, as shown in FIG. 4. For example, the first end and the second end are attached with the top handle section 202 and the inner portion of the sleeve 102 respectively by stitching. In an embodiment of the present disclosure, the pair of pulling straps 116 go through the pair of shoulder straps 112 and help the protector 108 to protract and retract. In an embodiment of the present disclosure, the rail strap 402 is configured to keep the protector 108 in place and centred while transitioning between the retracted position and the protracted position. Further, the rail strap 402 is configured to prevent the protector 108 from sliding out of the housing while moving the middle padded section 206 from the retracted position to the protracted position.

Figure 5A:
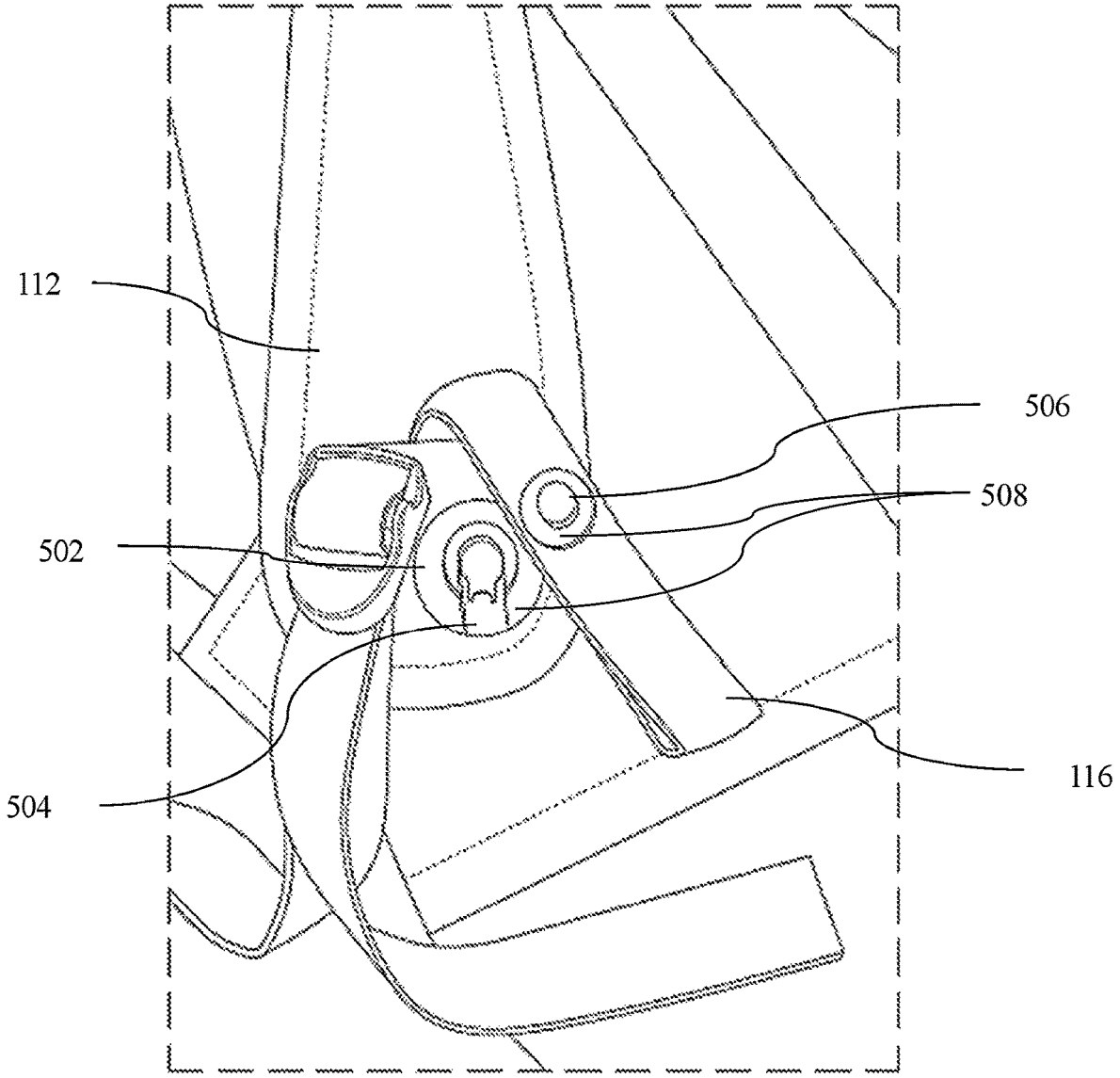
FIG. 5A is a top view of an exemplary magnetic pin released from a magnetic ring, in accordance with an embodiment of the present disclosure.
Figure 5B:
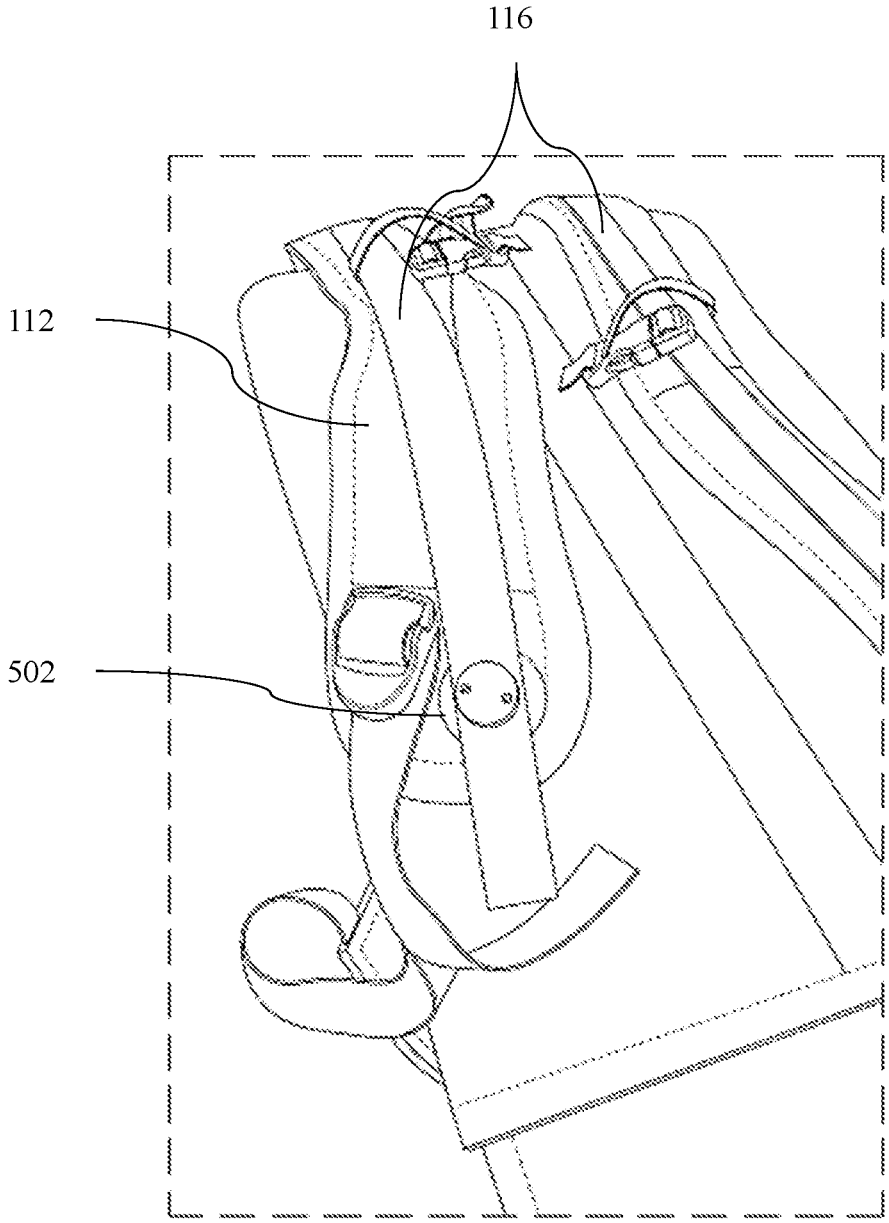
FIG. 5B is a top view of the exemplary magnetic pin removably attached with the magnetic ring, in accordance with an embodiment of the present disclosure.

FIG. 5A is a top view of an exemplary magnetic pin released from a magnetic ring, in accordance with an embodiment of the present disclosure. Further, FIG. 5B is a top view of the exemplary magnetic pin removably attached with the magnetic ring, in accordance with an embodiment of the present disclosure. For the sake of brevity, FIG. 5A and FIG. 5B have been explained together.

In an embodiment of the present disclosure, the backpack 100 includes a magnetic slide track fastener 508. The magnetic slide track fastener 508 includes a magnetic ring 502 fixed at bottom end of each of the pair of shoulder straps 112. The magnetic ring 502 includes a curved space 504 to facilitate upward sliding motion and a lower sliding motion of a magnetic pin 506. Further, the magnetic slide track fastener 508 includes the magnetic pin 506 fixed at a bottom end of each of the pair of pulling straps 116. When the magnetic pin 506 is released from the magnetic ring 502 via the downward sliding motion through the curved space 504, the middle padded section 206 protracts out of the sleeve 102 via the opening 110 due to movement of the pair of pulling straps 116 in downward direction. Since the bottom section 114 includes the predefined weight, the predefined weight enables the protector 108 to move in downward direction due to force of gravity resulting in protraction of the protector 108 i.e., the middle padded section 206. In an embodiment of the present disclosure, the middle padded section 206 is positioned over a seating surface to act as a protective layer between cloth worn by the user and the seating surface in the protracted position. When the pair of pulling straps 116 are pulled by the user, the middle padded section 206 retracts inside the sleeve 102 via the opening 110. Since the second end of each of the pair of pulling straps 116 is connected to the top handle section 202, pulling the pair of pulling straps 116 results in retraction of the middle padded section 206. In an embodiment of the present disclosure, the magnetic pin 506 is removably attached with the magnetic ring 502 via the upward sliding motion of the magnetic pin 506 through the curved space 504 to hold the middle padded section 206 in the retracted position inside the sleeve 102. The magnetic slide track fastener 508 holds the pair of pulling straps 116 in place when the seat is not in use.

Figure 6:
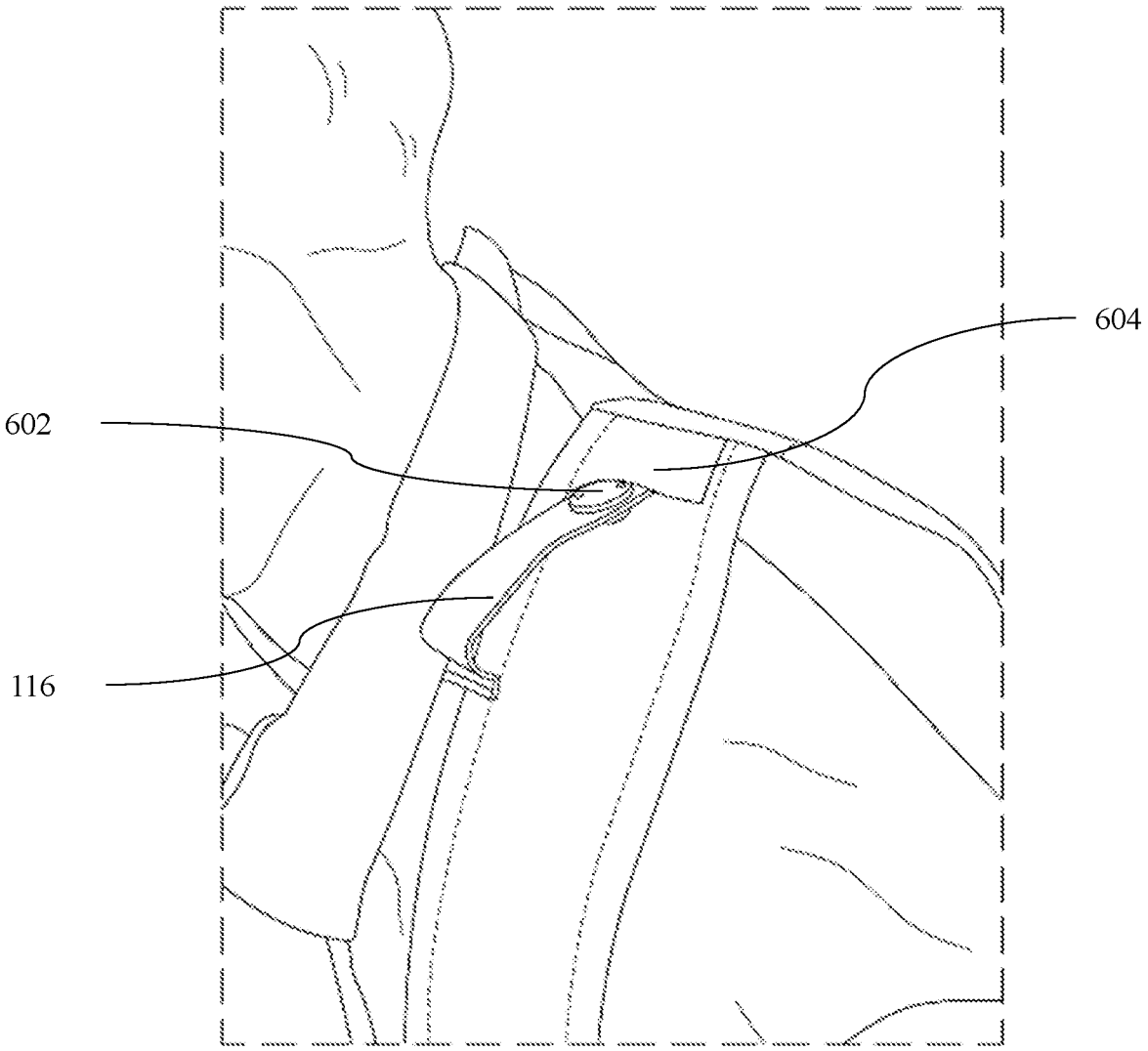
FIG. 6 is a side view of an exemplary cylindrical stopper piece attached to each of the pair of pulling straps, in accordance with an embodiment of the present disclosure.

FIG. 6 is a side view of an exemplary cylindrical stopper piece 602 attached to each of the pair of pulling straps 116, in accordance with an embodiment of the present disclosure. In an embodiment of the present disclosure, the backpack 100 includes a cylindrical stopper piece 602 attached to each of the pair of pulling straps 116 in proximity of the magnetic pin 506. The cylindrical stopper piece 602 is configured to stop movement of the pair of pulling straps 116 through the pair of shoulder straps 112 while moving the middle padded section 206 from the retracted position to the protracted position. In an embodiment of the present disclosure, each of the pair of shoulder straps 112 includes a stopping slit 604 with thickness less than the cylindrical stopper piece 602 to stop the cylindrical stopper piece 602 from passing through the stopping slit 604.

Figure 7:
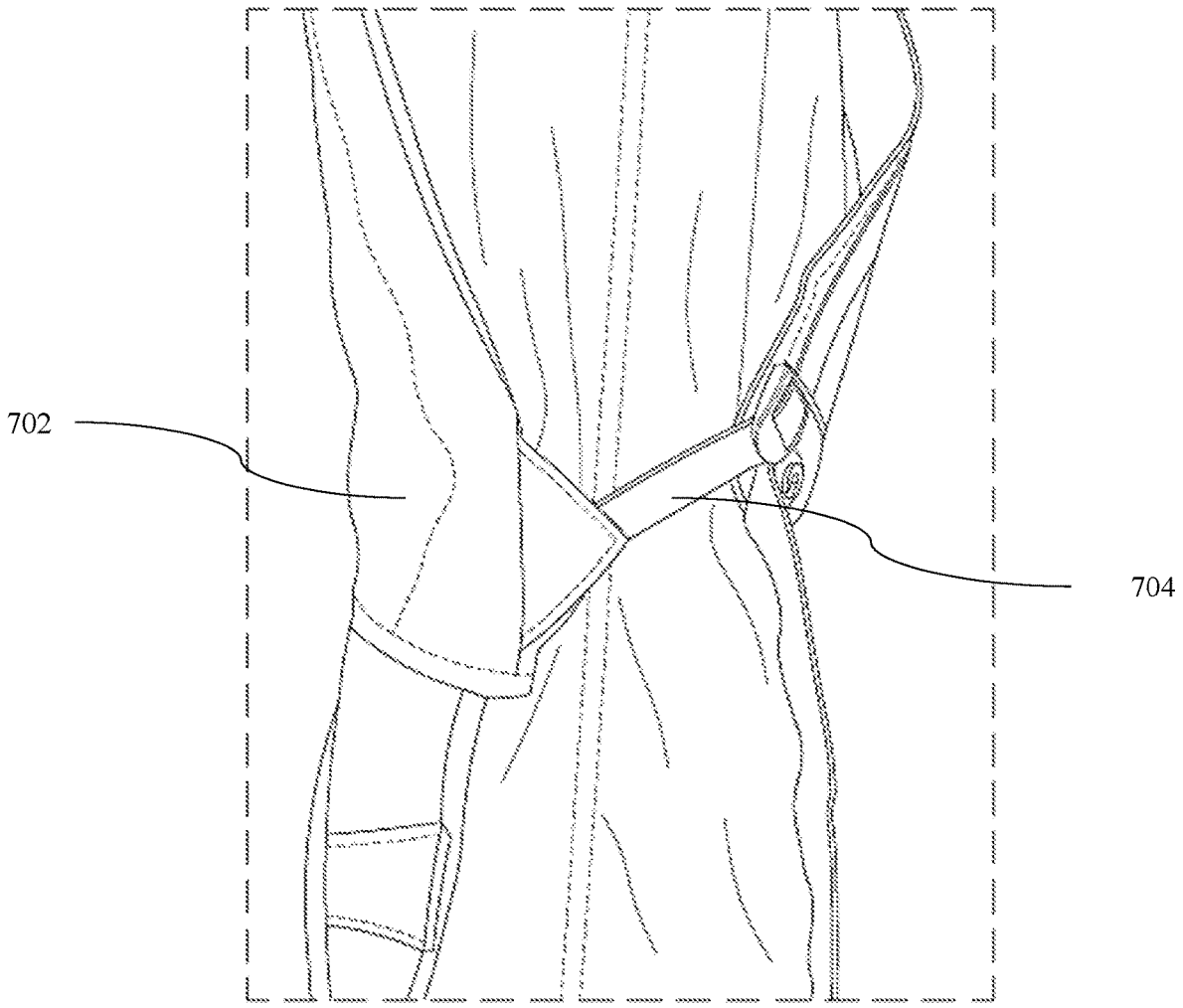
FIG. 7 is a side view of an exemplary pair of shoulder straps attached to a housing of the protector, in accordance with an embodiment of the present disclosure.

FIG. 7 is a side view of an exemplary pair of shoulder straps 112 attached to a housing of the protector 108, in accordance with an embodiment of the present disclosure.

Figure 8:
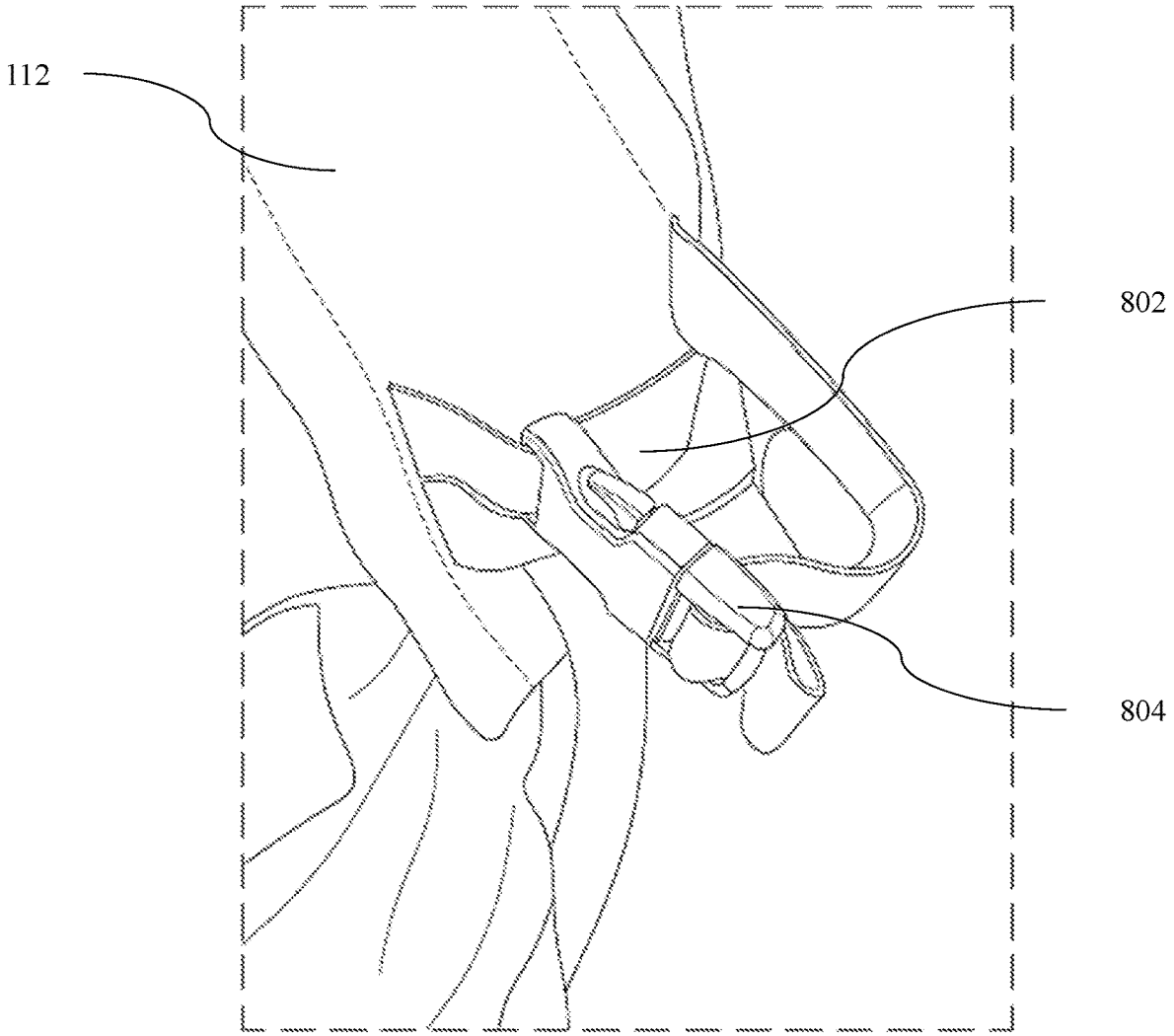
FIG. 8 is a front view of exemplary one or more fabrics and one or more buckles of the backpack, in accordance with an embodiment of the present disclosure.

FIG. 8 is a front view of exemplary one or more fabrics and one or more buckles of the backpack 100, in accordance with an embodiment of the present disclosure. In an embodiment of the present disclosure, the backpack 100 includes one or more fabrics 802 stitched on the pair of shoulder straps 112. The one or more fabrics 802 can be used to attach hooks and carabiners for holding one or more items. Further, the backpack 100 includes one or more buckles 804 to secure a user's personal backpack 100 and thus, making the backpack 100 and the personal backpack 100 as one unit.

FIG. 9A is a rear view of the exemplary backpack 100 in the protracted position, in accordance with an embodiment of the present disclosure. In an embodiment of the present disclosure, FIG. 9B is a rear view of the exemplary backpack 100 in the retracted position, in accordance with an embodiment of the present disclosure. For the sake of brevity, FIG. 9A and FIG. 9B have been explained together.

In FIG. 9A, the protector 108 of the backpack 100 is in the protracted position i.e., the protector 108 is fully extended out of the sleeve 102. In the protracted position, the middle padded section 206 is protracted outside the sleeve 102, the top handle section 202 in located inside the sleeve 102 and the bottom section 114 is protruding out of the opening 110 of the sleeve 102. Further, atop portion and a bottom portion of the protector 108 are lined with foam padding for comfort and support. In another embodiment of the present disclosure, the entire protector 108 is lined with foam padding. In FIG. 9B, the protector 108 of the backpack 100 is in the retracted position i.e., the protector 108 is fully retracted inside the sleeve 102. In the protracted position, the middle padded section 206 is retracted inside the sleeve 102, the top handle section 202 in located inside the sleeve 102 and the bottom section 114 is protruding out of the opening 110 of the sleeve 102. In an embodiment of the present disclosure, the protector 108 is lined with a set of non-slip patches i.e., non-slip material. In an embodiment of the present disclosure, the back portion of the backpack 100 is made with antimicrobial fabric i.e., copper infused fabric or some other type of bacteria resistant fabric.

Figure 10A:
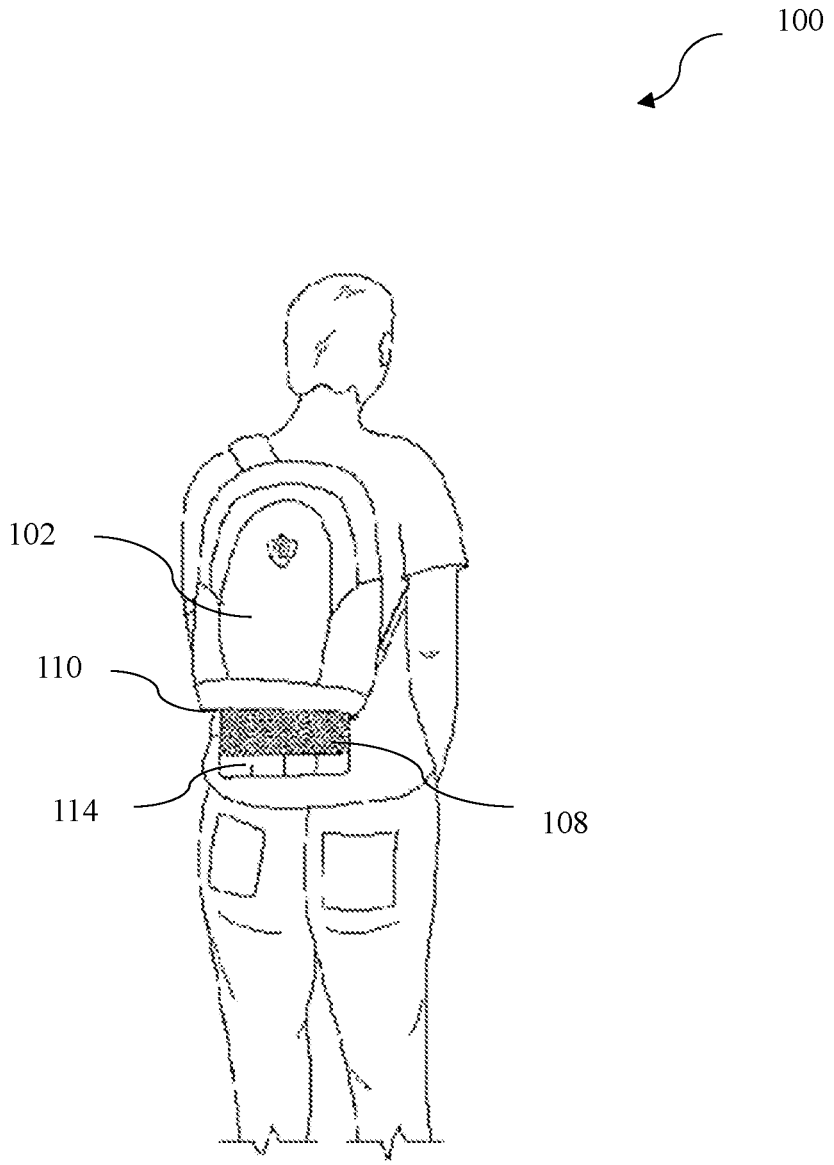
FIG. 10A is a front view of the exemplary backpack in the retracted position including the protector positioned on shoulder of a user, in accordance with an embodiment of the present disclosure.
Figure 10B:
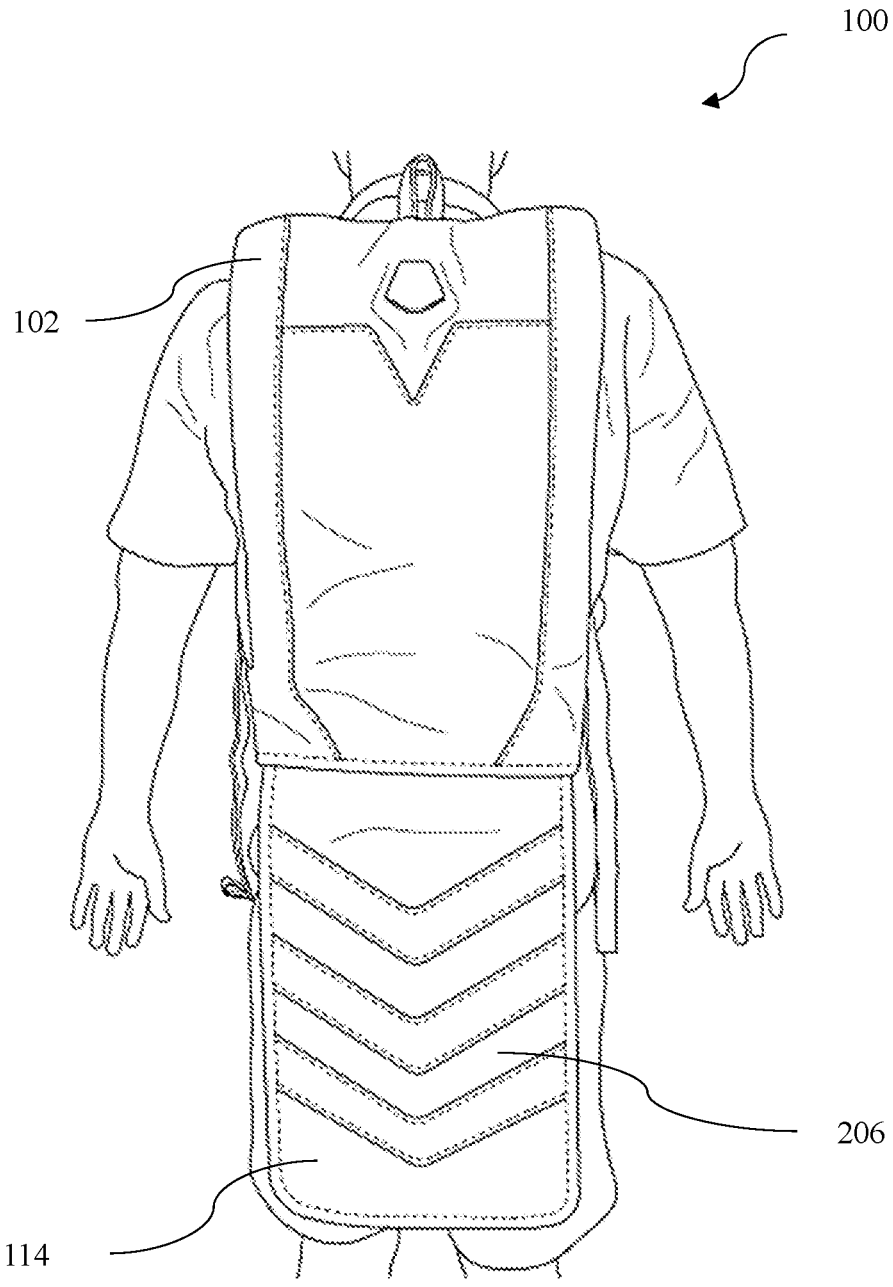
FIG. 10B is a front view of the exemplary backpack in the protracted position including the protector positioned on shoulder of the user, in accordance with an embodiment of the present disclosure.

FIG. 10A is a front view of the exemplary backpack 100 in the retracted position including the protector 108 positioned on shoulder of a user, in accordance with an embodiment of the present disclosure. FIG. 10B is a front view of the exemplary backpack 100 in the protracted position including the protector 108 positioned on shoulder of the user, in accordance with an embodiment of the present disclosure. For the sake of brevity, FIG. 10A and FIG. 10B have been explained together.

In an embodiment of the present disclosure, the backpack 100 including the protector 108 is worn by the user in public places, specially while taking public transport, and the like. The backpack 100 may also be worn as sling bag. In an embodiment of the present disclosure, the middle padded section 206 is positioned over a seating surface to act as a protective layer between cloth worn by the user and the seating surface in the protracted position, as shown in FIG. 10B.

Figure 11:
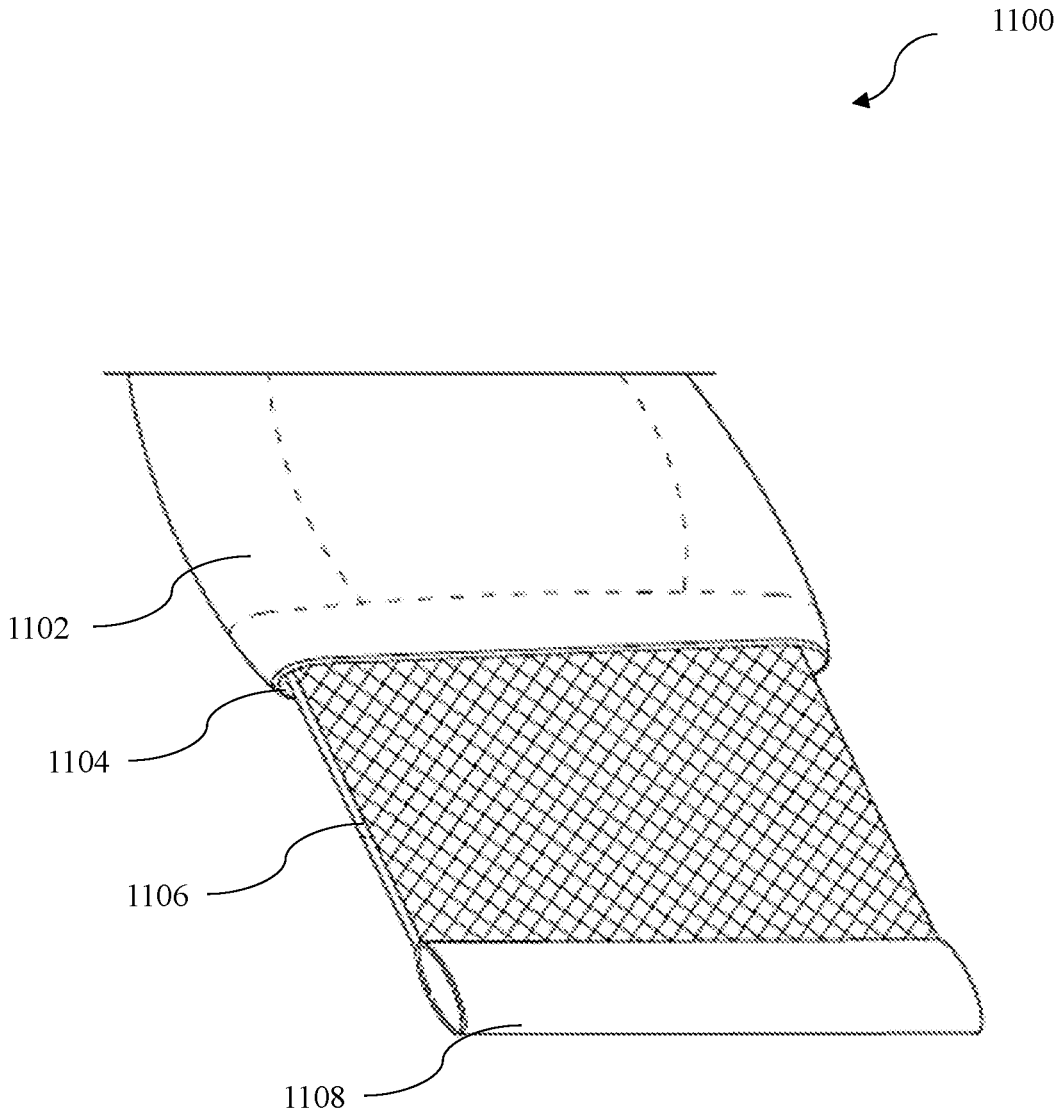
FIG. 11 is a front view of an exemplary wearable guard for preventing infections from surface and skin contact, in accordance with an embodiment of the present disclosure.

FIG. 11 is a front view of an exemplary wearable guard for preventing infections from surface and skin contact, in accordance with an embodiment of the present disclosure. The wearable guard 1100 includes a sleeve 1102 configured to be worn as a backpack or a sack. In such embodiment, the sleeve 1102 includes a predefined shape and size. In an exemplary embodiment of the present disclosure, the predefined shape includes rectangular, square, classic u-shape, oval, and the like.

Further, the sleeve 1102 is fabricated by joining a pair of sheets. In an embodiment of the present disclosure, edges of the pair of sheets are fused lengthwise to each other on a set of sides to form an opening 1104 at bottom side of the sleeve 1102. In an embodiment, the sleeve 1102 also includes a pair of shoulder straps coupled to a top portion and a bottom portion of the sleeve 1102. The pair of shoulder straps are configured to position the sleeve 1102 on a shoulder of a user. The wearable guard 1100 also includes a protector 1106 housed inside the sleeve 1102. The protector 1106 includes a top handle section connected with a pair of pulling straps. The pair of pulling straps passes through or alongside the pair of shoulder straps. The pair of pulling straps includes one or more predefined sections of one or more fastening means 118 to affix the top handle section to the sleeve 1102 at a convenient height with respect to the user. In an embodiment of the present disclosure, the pair of pulling straps enables a user to move the protector 1106 from a protracted position to a retracted position inside the sleeve 1102. As used herein the term 'straps' refers to strip of leather, cloth, or other flexible material, used to fasten, secure, or carry something or to hold on to something.

In an embodiment of the present disclosure, in the protracted position, a middle padded section is protracted outside the sleeve 1102 via the opening 1104. Further, in the retracted position, the middle padded section is retracted inside the sleeve 1102. In an embodiment of the present disclosure, the top handle section in located inside the sleeve 1102 and the bottom section 1108 is protruding out of the opening 1104 of the sleeve 1102 in both the retracted position and the protracted position of the middle padded section.

The protector 1106 also includes a padded portion, such as middle padded section 110 of FIG. 2, coupled to the top handle section and configured to act as a protective layer between a cloth worn by the user and a seating surface. In an exemplary embodiment, the padded portion includes an air permeable protective element so that it is not compressed and become uncomfortable to sit onto the padded portion of the protector 1106 for the user.

The protector 1106 also includes a bottom section 1108 coupled to the padded portion and protruding out of the opening 1104 of the sleeve 1102. The bottom section 1108 is configured to act as a handle enabling the user to pull the pair of pulling straps for moving the middle padded section from the retracted position to the protracted position. The middle padded section is moved from the retracted position to the protracted position for positioning the middle padded section over the seating surface to act as the protective layer between the cloth worn by the user and the seating surface.

The bottom section 1108 includes a predefined weight to add a pull weight to keep the protector 1106 straight, open and without fold for having a maximum coverage of the seating surface. The bottom section 1108 has more thickness as compared to the opening 1104 for allowing the bottom section 1108 to act as a stopper. Further, the bottom section 1108 acts as the stopper for preventing the middle padded section to be pulled in completely inside the sleeve 1102 while moving the middle padded section from the protracted position to the retracted position.

In an embodiment, the pair of pulling straps includes one or more predefined sections of one or more fastening means 118 to affix the top handle section to the sleeve 1102. In an exemplary embodiment of the present disclosure, the fastening means includes a zipper, buttons, clasps, hook and loop type fasteners, buckle fasteners, magnets or a combination thereof.

The protector 1106 is washable for removal of contamination and dirt. The protector 1106 is fabricated with a water-resistant material that is machine-washable and durable. The protector 1106 is fabricated from a set of materials, such as anti-microbial, copper oxide, silver ion, zinc, vinyl, polyester, natural fibres, artificial fibres, paper-based materials, and the like.

In an embodiment of the present disclosure, the wearable guard 1100 includes a magnetic slide track fastener 508. The magnetic slide track fastener 508 includes a magnetic ring fixed at a bottom end of each of the pair of shoulder straps. The magnetic ring includes a curved space to facilitate upward sliding motion and a lower sliding motion of a magnetic pin. Further, the wearable guard 1100 includes the magnetic pin fixed at a bottom end of each of the pair of pulling straps. When the magnetic pin is released from the magnetic ring via the downward sliding motion through the curved space, the middle padded section protracts out of the sleeve 1102 via the opening 1104 due to movement of the pair of pulling straps in downward direction. Furthermore, the middle padded section is positioned over a seating surface to act as a protective layer between cloth worn by the user and the seating surface in a protracted position. When the pair of pulling straps are pulled by the user, the middle padded section retracts inside the sleeve 1102 via the opening 1104. The magnetic pin is removably attached with the magnetic ring via the upward sliding motion of the magnetic pin through the curved space to hold the middle padded section in a retracted position inside the sleeve 1102.

Various embodiments of the present disclosure provide the backpack 100 and the wearable guard 1100 which helps in preventing contamination of the clothing of the user, thereby reducing spread of contagious infections which may spread by touch, direct skin contact, surface contact and the like. The the backpack 100 and the wearable guard 1100 are easy to use and easy to wash while being cost effective. In an embodiment of the present disclosure, the protector 108, 1106 is washable for removal of contamination and dirt. The protector is fabricated with the water-resistant material that is machine-washable and durable. The protector 108, 1106 can be made of anti-microbial, copper oxide, silver ion, zinc, vinyl, polyester, natural fibers, artificial fibers, paper-based materials or the like.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. A backpack for preventing infections from surface and skin contact, the backpack comprising:

a sleeve configured to cover a length of a backpack, wherein the length corresponds to a distance between a top end and a bottom end of the backpack, wherein the sleeve is fabricated by joining a pair of sheets, and wherein edges of the pair of sheets are fused lengthwise to each other on a set of sides to form an opening at bottom side of the backpack;

a pair of shoulder straps coupled to a top portion and a bottom portion of the sleeve, wherein the pair of shoulder straps are configured to position the sleeve on a shoulder of a user;

a protector housed inside the sleeve, wherein the protector comprises:

a top handle section connected with a pair of pulling straps, wherein the pair of pulling straps one of: passes through and alongside the pair of shoulder straps, wherein the pair of pulling straps comprises one or more predefined sections of one or more fastening means to affix the top handle section to the backpack at a convenient height with respect to the user;

a middle padded section coupled to the top handle section and configured to act as a protective layer between a cloth worn by a user and a seating surface; and a bottom section coupled to the middle padded section and protruding out of the opening of the sleeve;

a magnetic slide track fastener comprising:

a magnetic ring fixed at a bottom end of each of the pair of shoulder straps, wherein the magnetic ring comprises a curved space to facilitate upward sliding motion and a downward sliding motion of a magnetic pin; and the magnetic pin fixed at a bottom end of each of the pair of pulling straps, wherein when the magnetic pin is released from the magnetic ring via the downward sliding motion through the curved space, the middle padded section protracts out of the sleeve via the opening due to movement of the pair of pulling straps in a downward direction, wherein the middle padded section is positioned over a seating surface to act as a protective layer between cloth worn by the user and the seating surface in a protracted position, wherein when the pair of pulling straps are pulled by the user, the middle padded section retracts inside the sleeve via the opening, and wherein the magnetic pin is removably attached with the magnetic ring via the upward sliding motion of the magnetic pin through the curved space to hold the middle padded section in a retracted position inside the sleeve.

2. The backpack of claim 1, wherein the middle padded section is made up of self-disinfecting fabric.

3. The backpack of claim 2, wherein the self-disinfecting fabric is impregnated with one of: hydroxyapatite-binding silver TiO2 and quaternary ammonium salt.

4. The backpack of claim 1, wherein the bottom section is configured to act as a handle enabling the user to pull the pair of pulling straps for moving the middle padded section from the retracted position to the protracted position.

5. The backpack of claim 1, wherein the top handle section is connected to the pair of pulling straps enabling movement of the protector from the protracted position to the retracted position.

6. The backpack of claim 1, wherein the top handle section is located inside the sleeve and the bottom section is protruding out of the opening of the sleeve in both the retracted position and the protracted position of the middle padded section.

7. The backpack of claim 1, wherein the bottom section comprises a predefined weight to add a pull weight to keep the protector straight, open and without fold for having a maximum coverage of the seating surface.

8. The backpack of claim 1, wherein the bottom section has more thickness as compared to the opening for allowing the bottom section to act as a stopper, and wherein the bottom section acts as the stopper for preventing the middle padded section to be pulled in completely inside the sleeve while moving the middle padded section from the protracted position to the retracted position.

9. The backpack of claim 1, wherein the one or more fastening means comprise at least one of a zipper, buttons, clasps, hook and loop type fasteners, buckle fasteners, and magnets.

10. The backpack of claim 1, wherein the sleeve is detachably attached to the backpack by using one or more attaching means, and wherein the one or more attaching means comprise at least one of: knots, zipper, buttons, clasps, hook and loop type fasteners, buckle fasteners, and magnets.

11. The backpack of claim 1, wherein the protector is washable for removal of contamination and dirt.

12. The backpack of claim 1, wherein the protector is fabricated from a set of materials, and wherein the set of materials comprise a self-disinfecting, water-resistant, anti-microbial, copper oxide, silver ion, zinc, vinyl, polyester, natural fibres, artificial fibres, and paper based materials.

13. The backpack of claim 1, further comprising a rail strap comprising a first end and a second end, wherein the first end is attached with the top handle section, wherein the second end is connected with an inner portion of the sleeve, wherein the second end is attached with the top handle section, wherein the rail strap is configured to keep the protector in place and centred while transitioning between the retracted position and the protracted position, and wherein the rail strap is configured to prevent the protector from sliding out of the housing while moving the middle padded section from the retracted position to the protracted position.

14. The backpack of claim 1, further comprising a cylindrical stopper piece attached to each of the pair of pulling straps in proximity of the magnetic pin, wherein the cylindrical stopper piece is configured to stop movement of the pair of pulling straps through the pair of shoulder straps while moving the middle padded section from the retracted position to the protracted position, and wherein each of the pair of shoulder straps comprises a stopping slit with thickness less than the cylindrical stopper piece to stop the cylindrical stopper piece from passing through the stopping slit.

15. A wearable guard for preventing infections from surface and skin contact, the wearable guard comprising:

a sleeve configured to be worn as one of: a backpack and a sack, wherein the sleeve is fabricated by joining a pair of sheets, wherein edges of the pair of sheets are fused lengthwise to each other on a set of sides to form an opening at bottom side of the sleeve;

a pair of shoulder straps coupled to a top portion and a bottom portion of the sleeve, wherein the pair of shoulder straps are configured to position the sleeve on a shoulder of a user;

a protector housed inside the sleeve, wherein the protector comprises:

a top handle section connected with a pair of pulling straps, wherein the pair of pulling straps one of: passes through and alongside the pair of shoulder straps, wherein the pair of pulling straps comprises one or more predefined sections of one or more fastening means to affix the top handle section to the sleeve at a convenient height with respect to the user;

a middle padded section coupled to the top handle section and configured to act as a protective layer between a cloth worn by a user and a seating surface; and a bottom section coupled to the middle padded section and protruding out of the opening of the sleeve;

a magnetic slide track fastener comprising:

a magnetic ring fixed at a bottom end of each of the pair of shoulder straps, wherein the magnetic ring comprises a curved space to facilitate upward sliding motion and a downward sliding motion of a magnetic pin; and the magnetic pin fixed at a bottom end of each of the pair of pulling straps, wherein when the magnetic pin is released from the magnetic ring via the downward sliding motion through the curved space, the middle padded section protracts out of the sleeve via the opening due to movement of the pair of pulling straps in a downward direction, wherein the middle padded section is positioned over a seating surface to act as a protective layer between cloth worn by the user and the seating surface in a protracted position, wherein when the pair of pulling straps are pulled by the user, the middle padded section retracts inside the sleeve via the opening, and wherein the magnetic pin is removably attached with the magnetic ring via the upward sliding motion of the magnetic pin through the curved space to hold the middle padded section in a retracted position inside the sleeve.

16. The wearable guard of claim 15, wherein the bottom section is configured to act as a handle enabling the user to pull the pair of pulling straps for moving the middle padded section from the retracted position to the protracted position.

17. The wearable guard of claim 15, wherein the top handle section is connected to the pair of pulling straps enabling movement of the protector from the protracted position to the retracted position.

18. The wearable guard of claim 15, wherein the bottom section comprises a predefined weight to add a pull weight to keep the protector straight, open and without fold for having a maximum coverage of the seating surface.

19. The wearable guard of claim 15, wherein the bottom section has more thickness as compared to the opening for allowing the bottom section to act as a stopper, and wherein the bottom section acts as the stopper for preventing the middle padded section to be pulled in completely inside the sleeve while moving the middle padded section from the protracted position to the retracted position.

20. The wearable guard of claim 15, wherein the protector is fabricated from a set of materials, and wherein the set of materials comprise a self-disinfecting, water-resistant, anti-microbial, copper oxide, silver ion, zinc, vinyl, polyester, natural fibres, artificial fibres, and paper based materials.

* * * * *